US010500118B1

(12) United States Patent
Davis et al.

(10) Patent No.: US 10,500,118 B1
(45) Date of Patent: Dec. 10, 2019

(54) CASKET ARRANGEMENT WITH HANDLE CLEARANCE AND PERSONALIZATION RECEIVER

(71) Applicant: Vandor Corporation, Richmond, IN (US)

(72) Inventors: Justin F. Davis, Richmond, IN (US); Gerald H. Davis, Fountain City, IN (US)

(73) Assignee: Vandor Corporation, Richmond, IN (US)

( * ) Notice: Subject to any disclaimer, the term of this patent is extended or adjusted under 35 U.S.C. 154(b) by 0 days.

(21) Appl. No.: 16/193,779

(22) Filed: Nov. 16, 2018

(51) Int. Cl.
*A61G 17/04* (2006.01)
*G09F 3/20* (2006.01)
*G09F 1/10* (2006.01)

(52) U.S. Cl.
CPC ..... *A61G 17/041* (2016.11); *A61G 17/04* (2013.01); *G09F 1/10* (2013.01); *G09F 3/20* (2013.01)

(58) Field of Classification Search
CPC ..... A61G 17/04; A61G 17/041; A61G 17/00; G09F 1/10; G09F 3/20; G09F 23/00
USPC ..... 27/2, 19, 27; 40/658, 649, 661, 725
See application file for complete search history.

(56) References Cited

U.S. PATENT DOCUMENTS 4,267,623 A 5/1981 Christian
4,457,054 A * 7/1984 Craft ..... A61G 17/02 27/1
4,930,197 A * 6/1990 McClive ..... A61G 17/00 27/10
5,088,167 A 2/1992 Rahe
5,533,241 A * 7/1996 McConnell ..... A61G 17/04 27/27
5,689,869 A * 11/1997 Linville ..... A61G 17/04 27/1
5,727,291 A 3/1998 Biondo et al.
5,813,099 A 9/1998 Stewart
6,237,202 B1 * 5/2001 Agee ..... A61G 17/04 27/14
6,317,945 B1 11/2001 Laphan et al.
6,526,636 B2 * 3/2003 Bernhardt ..... A61G 17/08 27/1
6,557,222 B2 * 5/2003 Groemminger ..... A61G 17/04 27/10
6,715,190 B2 * 4/2004 Groemminger ..... A61G 17/04 27/14
6,763,558 B1 * 7/2004 Mytych ..... A61G 17/00 27/1
7,318,262 B1 * 1/2008 Florea ..... A61G 17/04 27/1

(Continued)

*Primary Examiner* — William L Miller
(74) *Attorney, Agent, or Firm* — Maginot, Moore & Beck LLP

(57) ABSTRACT

A casket arrangement includes a casket base, panels extending upwardly from the casket base, and a receiver fixedly coupled to at least one of the panels. Each panel includes inwardly facing and outwardly facing surfaces. At least one of the panels includes an opening formed through the inwardly facing surface and the outwardly facing surface. A receiver or guard is fixedly coupled to the inwardly facing surface of the at least one of the panels at a portion of the inwardly facing surface that is vertically between the opening and the casket base. At least a portion of the receiver is vertically aligned with the opening and spaced apart from the inwardly facing surface.

20 Claims, 5 Drawing Sheets

(56) References Cited

U.S. PATENT DOCUMENTS

| | | | | |
|---|---|---|---|---|
| 7,584,529 | B1 * | 9/2009 | Parker | A61G 17/02 27/14 |
| 7,657,981 | B2 * | 2/2010 | Parker | A61G 17/00 27/14 |
| 7,934,299 | B2 * | 5/2011 | Holzman | A61G 17/04 16/439 |
| 8,510,921 | B2 * | 8/2013 | Florea | A61G 17/04 27/1 |
| 2004/0040130 | A1 | 3/2004 | Teague | |
| 2010/0299895 | A1 | 12/2010 | Burlage et al. | |
| 2013/0086779 | A1 * | 4/2013 | Florea | A61G 17/08 27/1 |

* cited by examiner

CASKET ARRANGEMENT WITH HANDLE CLEARANCE AND PERSONALIZATION RECEIVER

FIELD OF THE INVENTION

The present invention relates generally to caskets, and more particularly, to arrangements of handles and personalization for caskets.

BACKGROUND

Burial containers and cremation containers, collectively caskets, often include handles to aid in transport of the deceased, by way of example, from the location of the memorial ceremony to the place of interment or crematory. For typical caskets formed of metal or wood products, the handles are fixedly attached to the outside of a casket. Because they are attached to the outside of the casket, the handles of current design increase the overall width dimension of the casket, which adds to shipping costs and can increase the space required at the interment site, and/or of the burial vault. Handles, and their connection to the caskets themselves, require significant structural strength in order to support the weight of the casket and the deceased. Handles having sufficient strength often have significant girth, thereby adding to the increase in the casket dimensions.

To this end, it will be appreciated that a typical casket handle adds at least six inches beyond the width of the casket that can be used to contain the deceased. Each handle must be placed at least two inches away from the outer surface of the casket to provide "handle clearance" that allows for the hand of the carrier to fit between the handle and the casket side to grasp the handle. Moreover, each handle must be at least approximately an inch thick to provide an ergonomic grasping surface. Thus, handles must extend at least three inches on each side, totaling at least an additional six inches in width, and typically more.

One method of implementing a handle with a limited increased footprint is to employ a movable handle that rests against the side of the casket when not in use. Such handles may be rotated upwardly and sufficiently away from the casket side to allow the handles to be gripped when the casket is to be moved. One such system employs pivotally connected handles that pivot outwardly to allow the carrier to grip the handle. A disadvantage of such systems can arise from the significant forces on the pivot joint when the casket is being lifted. The parts and structures of sufficient strength to handle such forces can require relatively costly materials. Other moveable handle mechanisms also contain many parts and are relatively expensive to manufacture.

In other design, some prior art metal caskets include a recessed handle cover formed in the casket side by punching or denting the metal side panel of the casket. The continuous metal of the casket side forms an indentation or "grotto" on the side of the casket that nevertheless maintains the integrity of the casket side. The indentation or "grotto" allows for handle clearance while reducing the overall width added by the handle arrangement. However, such a design is not amenable to caskets of other materials, such as wood, fiberboard or corrugated paper because those materials cannot be bent and worked in a way similar to metal.

There is therefore a need for a handle mechanism that reduces that additional width of the casket, without the disadvantages of the pivotally connected handles, and for such a handle mechanism or arrangement that is not limited to caskets constructed of materials that may be bent or worked in a manner similar to metal.

Additionally, it is desirable to provide loved ones with opportunities to personalize the casket to memorialize and celebrate the deceased. For example, a casket can be personalized by displaying mementos, photographs, images, and written passages that have special significance. One method of personalizing a casket includes affixing mementos or items to interior surfaces of the casket. However, these mementos and items cannot be viewed when the casket is closed, by way of example, during movement of the casket. One method of personalizing a casket such that mementos or items are visible even when the casket is closed includes affixing such mementos or items to outer surfaces of the casket. However, as discussed above, increasing the overall width dimension of the casket is undesirable. Additionally, when affixed to the outer surfaces of the casket, it is difficult to ensure that mementos and items are firmly attached and will not be damaged or disturbed during movement of the casket.

Therefore, there is also a need for casket personalization that allows mementos and items to be visible when the casket is closed, that ensures that the mementos and items will not be damaged during movement of the casket, and that does not contribute additional width to the casket.

SUMMARY

At least some embodiments of the present invention addresses the above-stated need, as well as others, by providing a casket having side panels with openings to provide for handle clearance. In some embodiments, a receiver structure is employed to prevent direct access to the interior, wherein receiver structure is configured to receive and display a decorative insert. The receiver is, for example, a framing arrangement.

A first embodiment is a casket arrangement includes a casket base, panels, a handle and guard. The panels extend upwardly from the casket base to define a container having an interior. Each panel includes an inwardly facing surface that faces the interior and an outwardly facing surface that faces away from the interior. At least one of the panels includes an opening formed through the inwardly facing surface and the outwardly facing surface, the opening having an opening perimeter. The handle is fixedly coupled to the at least one of the panels and disposed outward of the outwardly facing surface.

The guard is fixedly coupled to the inwardly facing surface of the at least one of the panels at a portion of the inwardly facing surface that is vertically between the opening and the casket base. The guard includes a ledge that is at least partially arranged between the opening and the casket base, the guard including a back supported by the ledge such that the back is spaced apart from a plane defined by the inwardly facing surface. The perimeter of the back is larger than that of the opening. At least a portion of the guard is vertically aligned with the opening, and at least a portion of the opening is vertically aligned with the handle.

A second embodiment is a casket arrangement that includes a casket base, panels, and a receiver. The panels extend upwardly from the casket base to define a container having an interior, each panel including an inwardly facing surface that faces the interior and an outwardly facing surface that faces away from the interior. At least one of the panels includes an opening extending through the inwardly facing surface and the outwardly facing surface. The receiver fixedly coupled to the inwardly facing surface of the at least one of the panels at a portion of the inwardly facing surface that is vertically between the opening and the casket base, wherein at least a portion of the receiver is vertically aligned with the opening, the receiver configured to support a decorative insert in a position inward of said inwardly facing surface, said decorative insert visible from an exterior of the casket arrangement.

The above described features and advantages, as well as others, will become more readily apparent to those of ordinary skill in the art by reference to the following detailed description and accompanying drawings.

DETAILED DESCRIPTION

Figure 1:
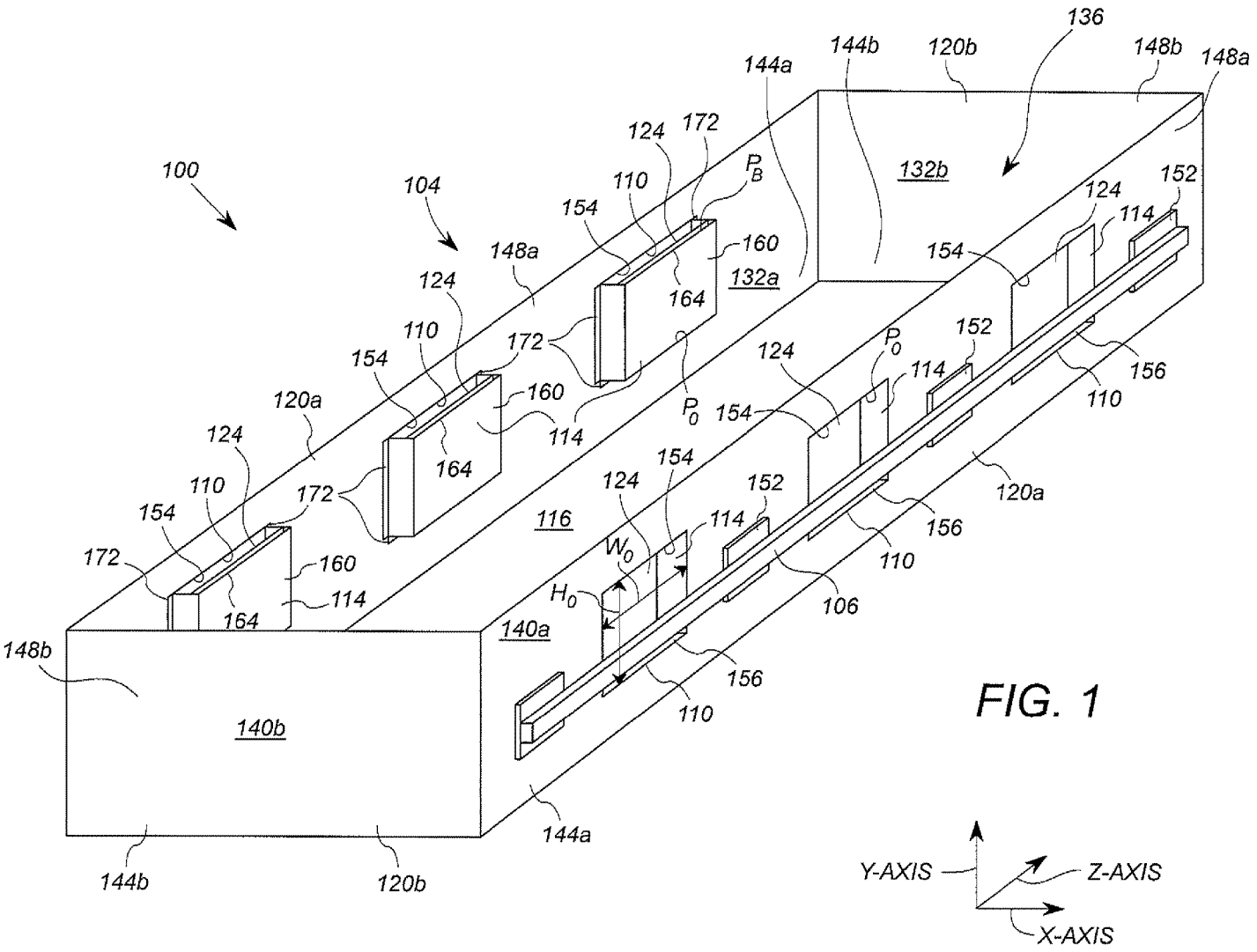
FIG. 1 depicts a perspective view a casket arrangement including openings at least partially vertically aligned with the handle.

FIG. 1 illustrates a perspective view of a casket arrangement 100 including a casket 104, handles 106, a plurality of openings 110, and a receiver 114 corresponding to each of the openings 110. As shown in FIG. 1, the casket 104 has a casket base 116, which forms the bottom of the casket 104, and panels 120*a*, 120*b* extending upwardly from the casket base 116 to form the sides of the casket 104 having an interior 136. The interior 136 in this embodiment is sized and configured to receives the body of an adult human.

Two of the panels 120*a* form longer sides of the casket 104, and one handle 106 is fixedly coupled to each of these two panels 120*a* to facilitate moving and carrying the casket arrangement 100. Each of these two panels 120*a* also includes openings 110 formed through the panel 120*a* to provide space (also referred to herein as "handle clearance") for the fingers, knuckles, and backs of the hands of casket carriers gripping the handles 106. As described in more detail below, the receivers 114 are fixedly coupled to the inside of the casket 104 on these two panels 120*a* in positions adjacent to and corresponding to each of the openings 110, and each receiver 114 is configured to receive and retain a personalization or decorative item 124 to be viewed through the corresponding opening 110. The two panels 120*a* in this embodiment have an identical structure. The receiver 114 also defines a hand guard that separates the knuckles and fingers of a person holding the handle 106 within handle clearance from the contents (e.g. a deceased human) in the interior 136. In an alternative embodiment, the receiver 114 need not be configured to receive or support a separate decorative item 124, but have the structure that defines the hand guard.

The other two panels 120*b* form the short sides or end panels of the casket 104. The two end panels 120*b* in this embodiment have an identical structure.

Figure 2:
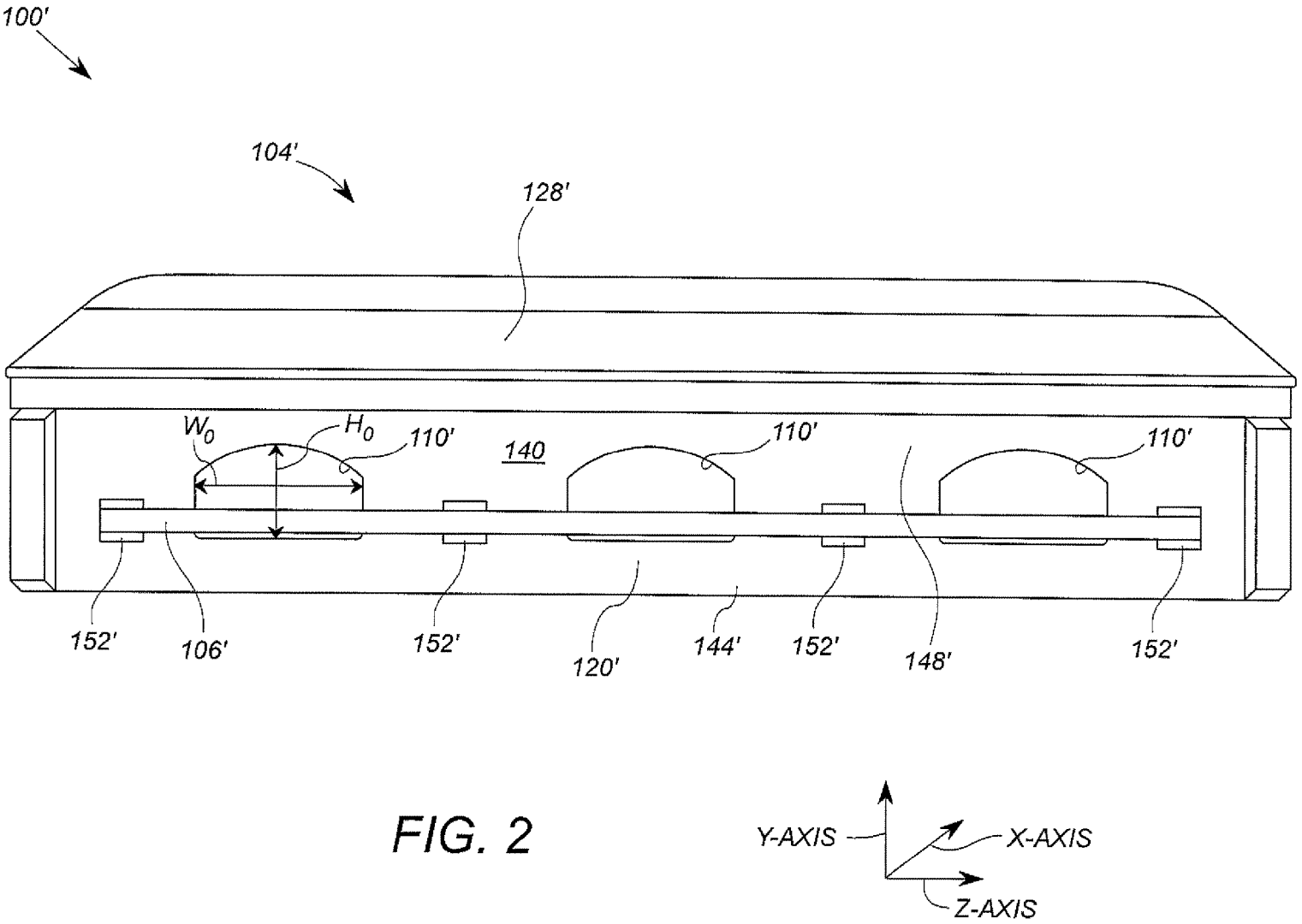
FIG. 2 depicts an alternative embodiment of the casket arrangement of FIG. 1.

Thus, in the embodiment shown in FIG. 1, the casket 104 is shaped as an open topped rectangular container having two longer sides and two shorter sides. Accordingly, the casket 104 has four rectangularly shaped panels 120*a*, 120*b*, two forming the longer sides and two forming the shorter sides of the casket 104, and a rectangularly shaped casket base 116. The panels 120*a*, 120*b* and the casket base 116 are arranged to form the open topped rectangular prism or box, which can be covered by a complementarily shaped lid. FIG. 1 depicts the casket arrangement 100 with the lid removed to show the interior thereof, but the embodiment shown in FIG. 2 depicts a lid 128'. In alternative embodiments, the casket 104 can have a different shape. Thus, the casket 104 can have a casket base 116 and/or panels having different shapes than those shown and/or the casket 104 can have a number of panels other than four.

Regardless of the shape of the casket 104, each of the panels 120*a*, 120*b* has a corresponding inwardly facing surface 132*a*, 132*b*, which faces inwardly, toward the other panels 120*a*, 120*b* and toward an interior 136 of the casket 104, and a corresponding outwardly facing surface 140*a*, 140*b*, which faces outwardly, away from the other panels 120*a*, 120*b* and away from the interior 136 of the casket 104. Thus, the inwardly facing surface 132*a* and the outwardly facing surface 140*a* of each corresponding panel 120*a* are on opposite sides of the panel 120*a*, and face in directions that are directly opposite one another. Likewise, the inwardly facing surface 132*b* and the outwardly facing surface 140*b* of each corresponding panel 120*b* are on opposite sides of the panel 120*b*, and face in directions that are directly opposite one another. Each panel 120*a*, 120*b* also has a corresponding bottom 144*a*, 144*b*, which is arranged vertically nearest to the casket base 116, and a corresponding top 148*a*, 148*b*, which is disposed vertically farthest from the casket base 116. As used herein, the term "vertically" refers to the direction extending along the y-axis of the drawing shown in FIG. 1.

Each handle 106 is fixedly coupled (directly or indirectly) to the outwardly facing surface 140*a* of one of the panels 120*a* that forms the longer sides of the casket 104. In FIG. 1, only one of the handles 106 is visible, as the other is obscured by the opposite panel 120*a* to which it is coupled. It will be appreciated that in other embodiments, handles may also be included on the panels 120*b* that form the shorter sides of the casket 104. In embodiments having handles included on the panels 120*b* that form the shorter sides of the casket 104, the panels 120*b* may include openings 110 and receivers 114 substantially similar to those formed on the panels 120*a*. Alternatively, the panels 120*b* may include openings 110 and receivers 114 despite including no handles. In which case, the openings 110 and receivers 114 included on the panels 120*b* provide additional opportunities for displaying personalization items 124 without also providing handle clearance.

In this embodiment, each handle 106 is fixedly coupled to the corresponding panel 120*a* via a plurality of spacer elements 152. The spacer elements 152 provide some clearance between the outwardly facing surface 140*a* and the handle 106, but not necessarily enough clearance for grasping the handle 106. Instead, it is the use of the spacer elements 152 combined with the opening 110 (and depth of the corresponding guard/receiver structure 114) that provides sufficient handle clearance at the openings 110. In some embodiments, the spacer elements 152 are not employed, and the corresponding depth of the receiver 114 is increased to compensate. However, it will be appreciated that the use of the spacer elements 152 allows the receiver 114 to intrude into the interior 136 to a lesser degree.

The handles 106, which are generally made of wood or a wood-like stiff material, but which may be plastic or other material, may be directly bolted to the panels 120*a*. In the case of panels 120*a* constructed of wood, any conventional bolt, nut and washer combination of suitable size, not shown, may be used. Typically, the bolt extends from the handle 106, through the panel 120*a* (and the optional spacer 152), and is secured by a nut that traps the washer against the inwardly facing surface 132*a*. To accommodate the decreased strength of panels 120*a* constructed of paperboard in other embodiments, the nut, bolt and washer are implemented in the same way, but the washer is wider than normal to distribute more widely the force over the inwardly facing surface 132*a*.

In any event, the handles 106 are connected at intermediate spots defined in FIG. 1 by the location of the spacers 152 in order to distribute the force of the load on the handle 106 over the length of the panel 120*a*. The length of the panel 120*a* extends in the direction along the z-axis in the drawing shown in FIG. 1. In the embodiment shown, each handle 106 is fixedly coupled to the corresponding panel 120*a* so as to be positionally fixed relative to the panel 120*a*. However, it will be appreciated that in other embodiments, the handles 106 can be fixedly coupled to the panels 120*a* so as to be movable relative to the panels 120*a*. Moreover, each of the handles 106 can be coupled to the corresponding panel 120*a* by other means of fixation which is sufficient to withstand the force of the load at the handle spacer 152.

The casket assembly 100 also includes three openings 110 in each of the panels 120*a* that form the longer sides of the casket 104. Each of the openings 110 is formed between two handle spacers (i.e. bolt connection locations) 152 and is formed through the inwardly facing surface 132*a* and the outwardly facing surface 140*a* of the panel 120*a* such that each opening 110 (without the receiver or guard 114) provides access to the interior 136 of the casket 104 through the panel 120*a*. The positioning of the openings 110 between the mounting locations (e.g. at the handle spacers 152) provides handle clearance at locations along the handle 106 that are gripped by a carrier. It will be appreciated, however, that in other embodiments, the casket assembly 100 could include more than three openings 110 in each of the panels 120*at*. For example, each of the panels 120*a* that form the longer sides of the casket 104 could include six openings 110, two between each of the handle spacers 152. Additionally, the casket assembly 100 could include further openings, which are substantially similar to the openings 110, positioned at locations other than between the handle spacers 152. For example, the casket assembly 100 could include further openings positioned vertically above the handle spacers 152. Such further openings would provide additional opportunities for displaying personalization items 124 without also providing handle clearance.

Each opening 110 is sized to enable viewing of personalization items 124. Accordingly, each opening 110 has an opening width $W_O$, which defines the extent of the opening 110 in the direction extending along the z-axis, and an opening height $H_O$, which defines the extent of the opening 110 in the direction extending along the y-axis. (In embodiments including openings 110 formed in the panels 120*a* that form the shorter sides of the casket 104, the opening width $W_O$ defines the extent of the opening 110 in the direction extending along the x-axis and the opening height $H_O$ defines the extent of the opening 110 in the direction extending along the y-axis.) By way of example, the opening width $W_O$ can be at least approximately seven inches, and the opening height $H_O$ can be at least approximately five inches. However, the opening width $W_O$ and opening height $H_O$ can have other dimensions which are sufficient to enable viewing of personalization items 124 and provide enough handle clearance to enable easily gripping the handles 106. In embodiments including openings 110 that provide opportunities for displaying personalization items 124 without also providing handle clearance, such openings can have dimensions which are sufficient to enable viewing of personalization items 124 but do not provide enough handle clearance to enable easily gripping the handles 106. Additionally, it will be appreciated that in alternative embodiments, each opening 110 may have a different shape, size, and/or dimensions than the other openings 110.

In the embodiment shown in FIG. 1, the openings 110 are rectangularly shaped. However, it will be appreciated that in other embodiments, the openings 110 can have shapes other than rectangles and that the openings 110 can be shaped as polygons, rounded shapes, or irregular shapes. For example, in the embodiment shown in FIG. 2, the openings 110' have rectangular bottoms and arched tops. The openings 110 can have any shape that provides handle clearance for gripping the handle 106 and that enables viewing the item 124 received in the corresponding receiver 114.

As noted above, the casket assembly 100 further includes a receiver 114 corresponding to each opening 110. Each receiver 114 is fixedly coupled to the inwardly facing surface 132*a* of one of the panels 120*a*, and each receiver 114 is configured to receive a personalization item 124 such that the item 124 is arranged on the interior 136 of the casket 104 and is visible through the corresponding opening 110. In embodiments including openings 110 formed in the panels 120*b* that form the shorter sides of the casket 104, the receivers 114 would be fixedly coupled to the inwardly facing surface 132*b* of one of the panels 120*b* such that a receiver 114 corresponds with each opening 110.

Figure 3A:
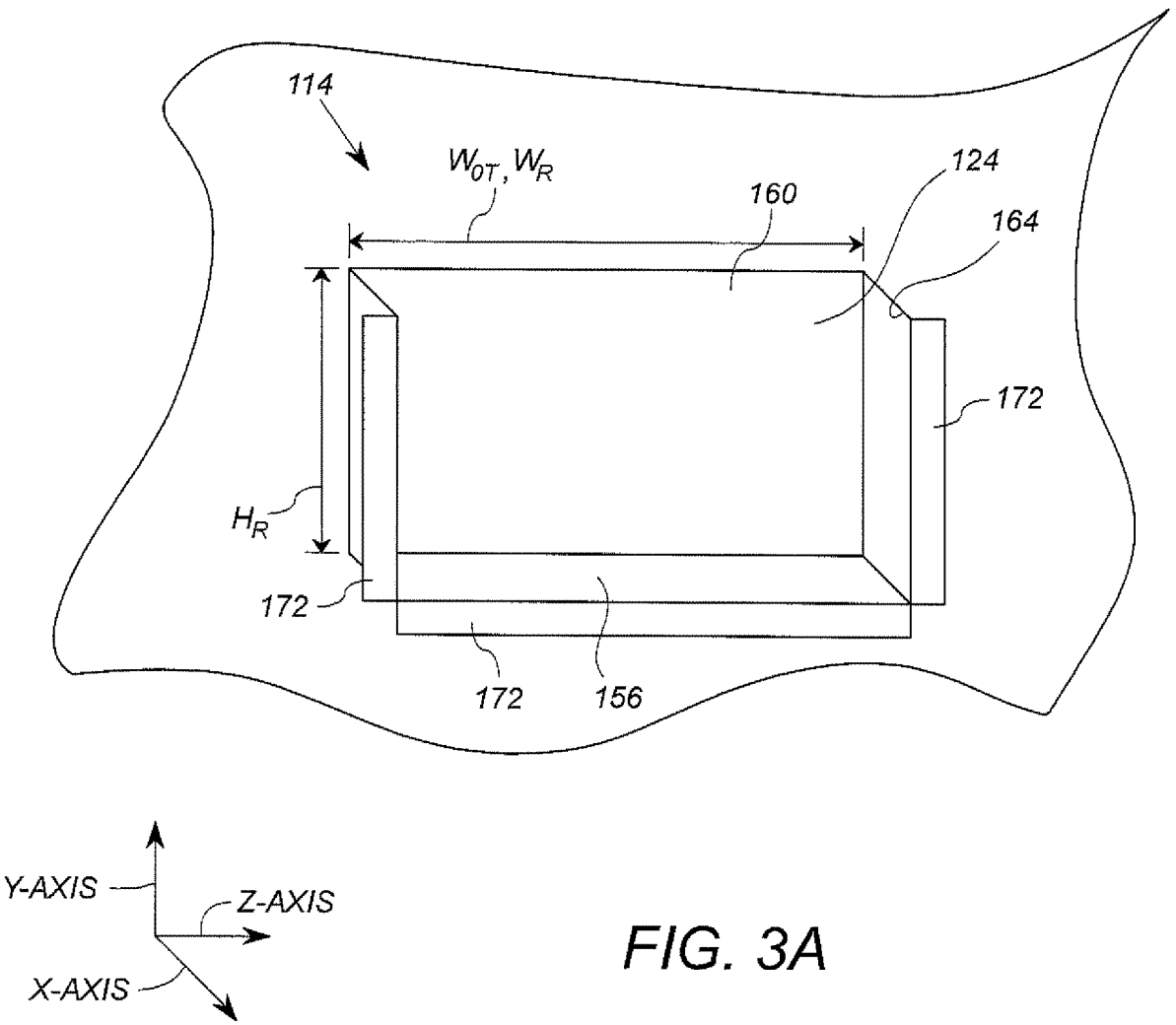
FIG. 3A depicts a perspective view of a fragmentary detail of the casket assembly of FIG. 1 including a receiver that is fixedly coupled to the casket arrangement.
Figure 3B:
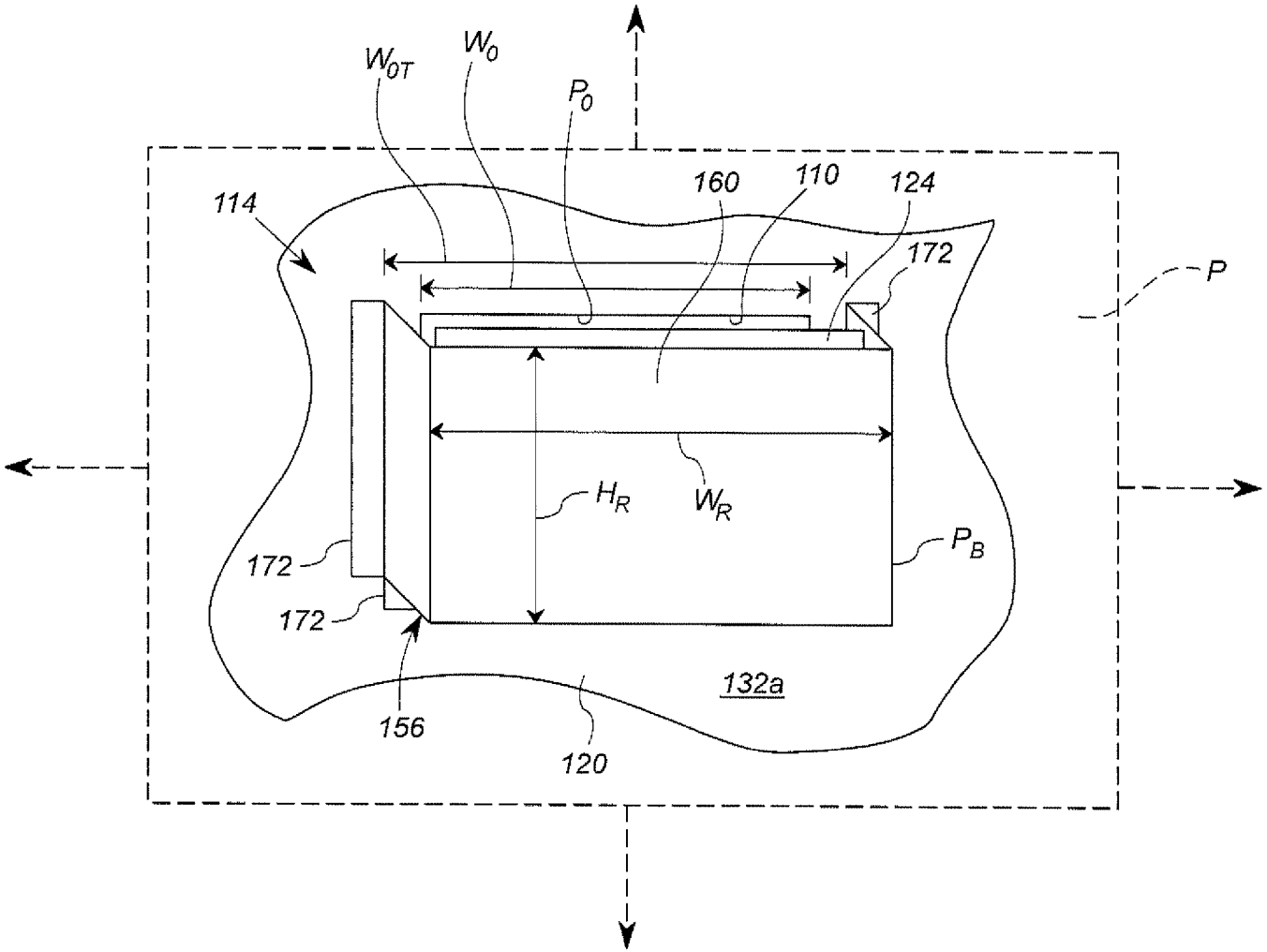
FIG. 3B depicts another perspective view of the fragmentary detail of the casket assembly of FIG. 1 including the receiver that is fixedly coupled to the casket arrangement.

The receiver 114 is shown in greater detail in FIGS. 3A and 3B. As shown, the receiver 114 includes a ledge 156 (shown in FIG. 3A) and a back 160. The ledge 156 is not visible in FIG. 3B, as it is obscured by the back 160, but its location is indicated by an arrow labeled 156. The ledge 156 provides a bottom support for the personalization item 124 (shown in FIG. 1) to prevent gravity from pulling the item 124 downwardly out of the receiver 114. In other words, the bottom of the item 124 can rest on the ledge 156 of the receiver 114. Accordingly, the ledge 156 is arranged on the inwardly facing surface 132*a* of the panel 120*a* at a position vertically between the opening 110 and the bottom 144*a* of the panel 120*a* (shown in FIG. 1) to position the item 124 to be visible through the opening 110. Thus, the receiver 114 is coupled, by way of the ledge 156, to the inwardly facing surface 132*a* of the panel 120*a* at a portion of the inwardly facing surface 132*a* that is vertically between the opening 110 and the casket base 116 (shown in FIG. 1).

The back 160 is supported by the ledge 156 and is spaced apart from a plane P (shown in FIG. 3B) defined by the inwardly facing surface 132*a* of the panel 120*a* to which the receiver 114 is coupled. More specifically, the inwardly facing surface 132*a* of the panel 120*a* lies in the plane P that is parallel to the y-axis and to the z-axis. The back 160 of the receiver 114 does not lie in this same plane P, but is spaced apart from plane P by the ledge 156 such that the back 160 is parallel to the plane P. (In embodiments where the panels 120*b* forming the shorter sides of the casket 104 have openings 110, the plane P' is parallel to the x-axis and to the y-axis.) Accordingly, the item 124 can be inserted into and retained within the receiver 114 between the back 160 of the receiver 114 and the inwardly facing surface 132*a* of the panel 120*a*.

Each receiver 114 is sized and positioned such that when the receiver 114 is coupled to the panel 120, the receiver 114 covers the entire corresponding opening 110, ensuring that the deceased cannot be viewed or contacted via the opening 110. Accordingly, at least a portion of each receiver 114 is vertically aligned with the corresponding opening 110, at least a portion of each receiver 114 is positioned vertically above the corresponding opening 110, and at least a portion of each receiver is positioned vertically below the corresponding opening 110. Furthermore, each receiver 114 has a receiver width $W_R$, which defines the extent of the receiver 114 in the direction extending along the z-axis, and a receiver height $H_R$, which defines the extent of the receiver 114 in the direction extending along the y-axis. The receiver width $W_R$ is equal to or larger than the opening width $W_O$ (shown in FIG. 1), and the receiver height $H_R$ is equal to or larger than the opening height $H_O$ (shown in FIG. 1), so that when the receiver 114 is coupled to the panel 120, the receiver 114 covers the entire opening width $W_O$ and the entire opening height $H_O$.

When the receiver 114 is coupled to the panel 120, the receiver 114 has an open top 164 that is formed between the back 160 of the receiver 114 and the plane P defined by the inwardly facing surface 132*a* of the panel 120*a*. This open top 164 enables the item 124 to be inserted into the receiver 114 from above. The open top 164 also has an open top width $W_{OT}$ which defines the extent of the open top 164 in the direction extending along the z-axis. The open top width $W_{OT}$ is equal to the receiver width $W_R$, and is also therefore equal or larger than the opening width $W_O$, so that the entire open top 164 of the receiver 114 can be utilized when inserting an item 124 into the receiver 114.

Furthermore, when the receiver 114 is coupled to the panel 120*a*, the open top 164 of the receiver 114 is vertically aligned with a portion of the inwardly facing surface 132*a* that is vertically between the opening 110 and the top 148*a* of the panel 120*a*. Accordingly, the back 160 of the receiver 114 extends in the direction along the y-axis to a position that is vertically above a top 154 of the opening 110. The position of the open top 164 of the receiver 114 relative to the top 154 of the opening 110 and the size of the open top width $W_{OT}$ and the receiver width $W_R$ relative to the opening width $W_O$ enable the receiver 114 to retain an item 124 that is larger than the opening 110, and thus facilitate retention of the item 124 in the receiver 114 without the item 124 passing through the opening 110.

Moreover, the opening 110 has an opening perimeter $P_O$ (also shown in FIG. 1), which defines the extents of the opening 110 in the direction of the y-axis and in the direction of the z-axis, and the back 160 has a back perimeter $P_B$ (also shown in FIG. 1), which defines the extents of the back 160 in the direction of the y-axis and in the direction of the z-axis. (In the case of openings 110 formed in the panels 120*b* that form the shorter sides of the casket 104, the opening perimeter $P_O$ defines the extents of the opening 110 in the direction of the y-axis and in the direction of the x-axis, and the back perimeter $P_B$ defines the extents of the back 160 in the direction of the y-axis and in the direction of the x-axis.) The back perimeter $P_B$ is larger than the opening perimeter $P_O$, to facilitate retention of the item 124 in the receiver 114 without the item 124 passing through the opening 110.

As shown in FIG. 1, at least a portion of each opening 110 is vertically aligned with the handle 106 to enable grabbing the handle 106 by passing the hand through the opening 110 and thus, at least partially into the receiver 114. As discussed above, the receiver 114 is at least as large as the corresponding opening 110 and is positioned to cover the entire corresponding opening 110. Accordingly, at least a portion of each receiver 114 is also vertically aligned with the handle 106.

The personalization item 124 is configured to be inserted into the receiver 114 through the open top 164 between the back 160 of the receiver 114 and the inwardly facing surface 132*a* of the panel 120*a*. In the embodiment shown in FIG. 1, the item 124 is a decorative insert and is configured to be removably inserted into the receiver 114 such that at least a portion of the item 124 is vertically aligned with the opening 110. More specifically, the item 124 is, for example, a photograph, a printed image, a card, or another article configured to fit in the receiver 114. The item 124 can be affixed to the back 160 of the receiver 114 by, for example, an adhesive, to hold the item 124 in place in the receiver 114 during use of the casket 104.

In the embodiment shown in FIG. 1, the item 124 has an item perimeter $P_I$ (only part of which is visible) that is larger than the opening perimeter $P_O$ such that the entire opening 110 is visually filled by the item 124. Moreover, in the embodiment shown in FIG. 1, the item 124 is sturdy and durable enough that it will not be damaged by hands reaching through the opening 110 to grasp the handle 106. However, it will be appreciated that in other embodiments, if the item 124 is more flexible and/or delicate, the item 124 can be mounted to a backing material that increases the stiffness and durability of the item 124.

Figure 4:
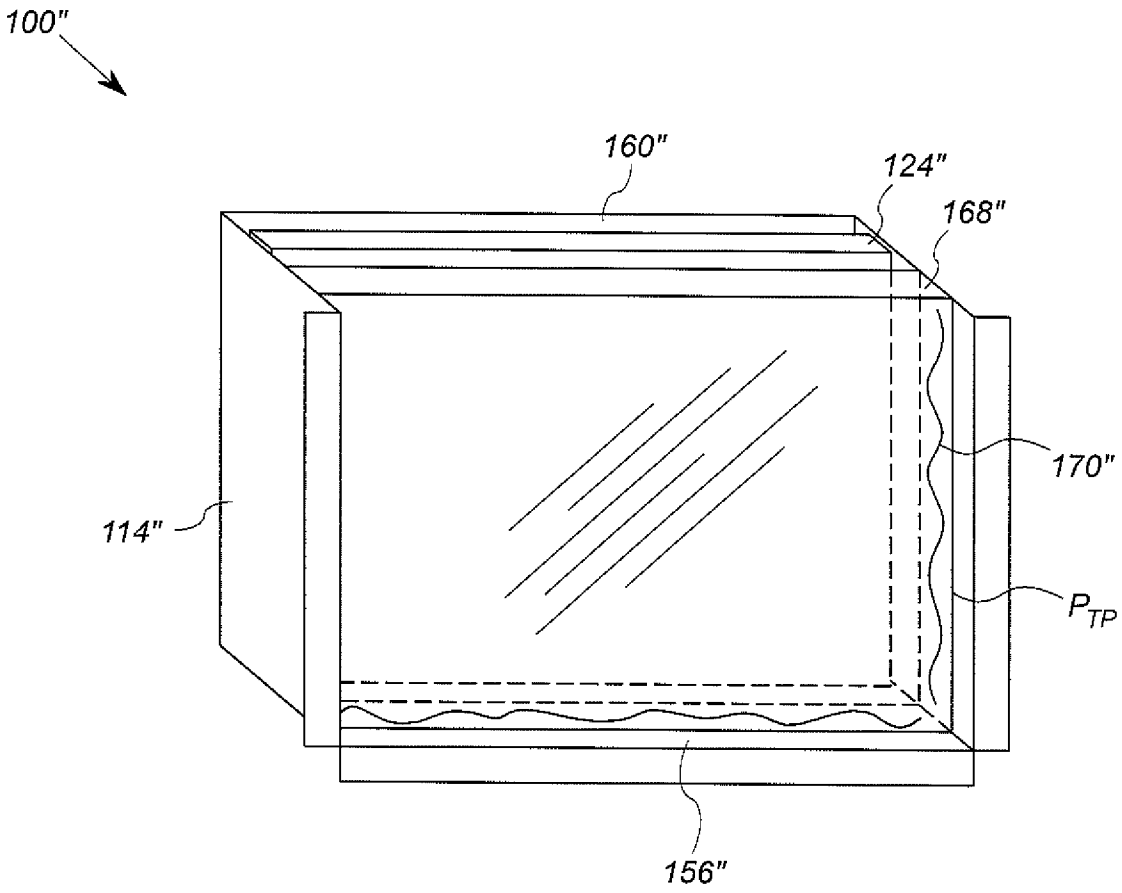
FIG. 4 depicts an alternative embodiment of the receiver shown in FIGS. 3A and 3B.

In another embodiment, shown in FIG. 4, the item 124" is held in place in the receiver 114" by a transparent panel 168". The embodiment shown in FIG. 4 is substantially similar to the embodiment shown in FIG. 1, except for the inclusion of the transparent panel 168". Accordingly, FIG. 4 only depicts the receiver 114" of the embodiment. As shown, the item 124" is removably inserted in the receiver 114" between the back 160" and the transparent panel 168" such that at least a portion of the item 124" is vertically aligned with the corresponding opening (not shown in FIG. 4).

In the embodiment shown in FIG. 4, the transparent panel 168" is sized to be smaller than the receiver 114" but larger than the corresponding opening. Accordingly, the transparent panel 168", like the item 124", is received within the receiver 114" so as to be arranged between the back 160" of the receiver 114" and the inwardly facing surface of the corresponding panel (not shown in FIG. 4). At least a portion of the transparent panel 168" is vertically aligned with the corresponding opening, and the transparent panel 168" is prevented from passing outwardly through the opening. In this embodiment, a flexible and/or delicate item 124" can be inserted into the receiver 114", because the transparent panel 168" acts as a stiff and durable material to protect the item 124" from being inadvertently moved or damaged by hands reaching through the opening to grasp the handle (not shown in FIG. 4).

The transparent panel 168" can be held in place in the receiver 114" by, for example, adhesive 170" applied to the ledge 156" and/or to the perimeter $P_{TP}$ of the transparent panel 168". Alternatively, the transparent panel 168" can be held in place by a groove formed in the ledge 156" and configured to receive the perimeter $P_{TP}$ of the transparent panel 168" therein. In embodiments where the transparent panel 168" is held in place by a groove, the transparent panel 168" can be the same size or larger than the receiver 114".

In the embodiment shown in FIG. 1, the ledge 156 of each receiver 114 extends along the entire back perimeter $P_B$ except for along the open top 164 of the receiver 114. However, it will be appreciated that in other embodiments, the ledge 156 can extend along a smaller amount of the back perimeter $P_B$ than is shown in FIG. 1. Additionally, the ledge 156 can be embodied as more than one separate ledge portion arranged spaced apart along the back perimeter $P_B$ to separate the back 160 from the inwardly facing surface 132*a* of the panel 120*a*.

In the embodiment shown in FIG. 1, each receiver 114 also includes three flanges 172 configured to fixedly couple the receiver 114 to the inwardly facing surface 132*a* of the panel 120*a* around the opening perimeter $P_O$. In the embodiment shown, the receiver 114 includes flanges 172 extending from the ledge 156 along each side of the receiver 114 except for along the open top 164 of the receiver 114. However, it will be appreciated that in other embodiments, the receiver 114 could include one continuous flange extending continuously from the entire ledge 156 of the receiver 114 except for along the open top 164 of the receiver 114. Additionally, the flange 172 can be embodied as more than three flanges 172 that are spaced apart along the ledge 156. The flanges 172 are fixedly coupled to the inwardly facing surface 132*a* of the panel 120*a* to fixedly couple the receiver 114 to the panel 120*a*. By way of example, the flanges 172 can be fixedly coupled to the inwardly facing surface 132*a* by adhesive, by staples, by nails, or by another type of fastener. In yet another alternative embodiment, the receiver 114 can include no flanges and the ledge 156 can be directly fixedly coupled to the inwardly facing surface 132*a* of the panel 120*a*.

In the embodiment shown in FIG. 1, the receiver 114 is rigid and is immovable relative to the panel 120*a*. However, it will be appreciated that in other embodiments, the receiver 114 can be flexible and/or movable relative to the inwardly facing surface 132*a* of the panel 120*a*. For example, the receiver 114 can be embodied as a resilient clip such that the back 160 is movable away from the inwardly facing surface 132*a* of the panel 120*a* by the application of force, and automatically returns toward the inwardly facing surface 132*a* of the panel 120*a* upon the removal of the force.

In the embodiment shown in FIG. 1, the receiver 114 covers all of the opening 110 in the panel 120*a*. However, it will be appreciated that in other embodiments, the receiver 114 can cover only a portion of the opening 110. In such embodiments, the open top 164 of the receiver 114 is vertically aligned with the opening 110. In such embodiments, the item 124 still covers the entire opening 110, but is not completely supported by the back 160 of the receiver 114.

As discussed further above, the structure of the receiver 114 may readily be adapted to function as a handguard with no personalization item 124 or other decorative insert. Indeed, such a guard itself may have its own integral pattern or design, such that an insert 124 is not necessary. It will be appreciated that the decorative insert for the receiver need not be a unique design, but may one of multiple standard decorative designs. A design may include, among other things, one or more patterns, one or more colors, photographs, or combinations thereof.

It will be appreciated that the above identified embodiments are merely illustrative, and that those of ordinary skill in the art may readily devise their own implementations and modifications that incorporate the principles of the present invention and fall within the spirit and scope thereof.

What is claimed is:

1. A casket arrangement, comprising:

a casket base;

panels extending upwardly from the casket base to define a container having an interior, each panel including an inwardly facing surface that faces the interior and an outwardly facing surface that faces away from the interior, wherein at least one of the panels includes an opening extending through the inwardly facing surface and the outwardly facing surface; and a receiver fixedly coupled to the inwardly facing surface of the at least one of the panels at a portion of the inwardly facing surface that is vertically between the opening and the casket base, wherein at least a portion of the receiver is vertically aligned with the opening, the receiver configured to support a decorative insert in a position inward of said inwardly facing surface, said decorative insert visible from an exterior of the casket arrangement.

2. The casket arrangement of claim 1, wherein:

the receiver includes a ledge that is at least partially arranged between the opening and the casket base; and the receiver includes a back supported by the ledge such that the back is spaced apart from a plane defined by the inwardly facing surface.

3. The casket arrangement of claim 2, wherein:

at least a portion of the back is parallel to the plane defined by the inwardly facing surface.

4. The casket arrangement of claim 2, wherein:

the receiver has an open top that is formed between the back and the plane defined by the inwardly facing surface.

5. The casket arrangement of claim 4, wherein:

the opening has an opening width, and the open top of the receiver has an open top width that is larger than the opening width.

6. The casket arrangement of claim 4, wherein:

the at least one of the panels has a bottom, which is disposed nearest to the casket base, and a top opposite the bottom, and the open top of the receiver is vertically aligned with a portion of the inwardly facing surface that is vertically between the opening and the top of the at least one of the panels.

7. The casket arrangement of claim 6, wherein:

the opening has an opening width, and the open top of the receiver has an open top width that is larger than the opening width.

8. The casket arrangement of claim 2, wherein:

the opening has an opening perimeter, and the back has a back perimeter that is larger than the opening perimeter.

9. The casket arrangement of claim 1, wherein:

the at least one of the panels further includes a handle disposed outward of the outwardly facing surface, and at least a portion of the opening is vertically aligned with the handle.

10. The casket arrangement of claim 1, further comprising:

a transparent panel arranged between the receiver and the inwardly facing surface, and wherein the receiver is configured to receive the decorative object between a back of the receiver and the transparent panel.

11. A casket arrangement, comprising:

a casket base;

panels formed extending upwardly from the casket base define a container having an interior, each panel including an inwardly facing surface that faces the interior and an outwardly facing surface that faces away from the interior, wherein at least one of the panels includes an opening formed through the inwardly facing surface and the outwardly facing surface, the opening having an opening perimeter;

a handle fixedly coupled to the at least one of the panels and disposed outward of the outwardly facing surface; and a guard fixedly coupled to the inwardly facing surface of the at least one of the panels at a portion of the inwardly facing surface that is vertically between the opening and the casket base, the guard including a ledge that is at least partially arranged between the opening and the casket base, the guard including a back supported by the ledge such that the back is spaced apart from a plane defined by the inwardly facing surface, the back having a back perimeter that is larger than the opening perimeter, wherein at least a portion of the guard is vertically aligned with the opening, and at least a portion of the opening is vertically aligned with the handle.

12. The casket arrangement of claim 11, wherein:

at least a portion of the back is parallel to the plane defined by the inwardly facing surface.

13. The casket arrangement of claim 11, wherein:

the guard has an open top that is formed between the back and the plane defined by the inwardly facing surface.

14. The casket arrangement of claim 13, wherein:

the opening has an opening width, and the open top of the guard has an open top width that is larger than the opening width.

15. The casket arrangement of claim 13, wherein:

the at least one of the panels has a bottom, which is arranged vertically nearest to the casket base, and a top opposite the bottom, and the open top of the guard is vertically aligned with a portion of the inwardly facing surface that is vertically between the opening and the top of the at least one of the panels.

16. The casket arrangement of claim 15, wherein:

the opening has an opening width, and the open top of the guard has an open top width that is larger than the opening width.

17. The casket arrangement of claim 11, further comprising:

an insert configured to be removably inserted between the back of the guard and the inwardly facing surface of the at least one of the panels such that at least a portion of the insert is vertically aligned with the opening.

18. The casket arrangement of claim 17, wherein:

the opening has an opening perimeter, and the insert has an insert perimeter that is larger than the opening perimeter.

19. The casket arrangement of claim 11, further comprising:

a transparent panel arranged between the back of the guard and the inwardly facing surface of the at least one of the panels such that at least a portion of the transparent panel is vertically aligned with the opening.

20. The casket arrangement of claim 19, further comprising:

an insert configured to be removably inserted between the back of the guard and the transparent panel such that at least a portion of the insert is vertically aligned with the opening.

* * * * *